US007001144B2

(12) United States Patent
Urban et al.

(10) Patent No.: US 7,001,144 B2
(45) Date of Patent: Feb. 21, 2006

(54) GAS TURBINE AND METHOD FOR REDUCING BUCKET TIP SHROUD CREEP RATE

(75) Inventors: John P. Urban, Greer, SC (US); Pat Mohr, Greer, SC (US); Emilio Fernandez, Taylors, SC (US); Hui Kuang, Greenville, SC (US); Robert R. Berry, Anderson, SC (US)

(73) Assignee: General Electric Company, Schenectady, NY (US)

( * ) Notice: Subject to any disclaimer, the term of this patent is extended or adjusted under 35 U.S.C. 154(b) by 281 days.

(21) Appl. No.: 10/373,845

(22) Filed: Feb. 27, 2003

(65) Prior Publication Data

US 2004/0170500 A1 Sep. 2, 2004

(51) Int. Cl.
*F01D 11/08* (2006.01)

(52) U.S. Cl. ..... 415/173.1; 415/173.4; 415/173.5; 416/189; 416/190

(58) Field of Classification Search ..... 415/173.1, 415/173.5, 173.6, 228, 173.4; 416/189, 190, 416/191, 192, 195
See application file for complete search history.

(56) References Cited

U.S. PATENT DOCUMENTS

| | | | | | |
|---|---|---|---|---|---|
| 4,111,604 | A | | 9/1978 | Kydd | |
| 5,125,798 | A | | 6/1992 | Muth et al. | |
| 5,183,389 | A | | 2/1993 | Gilchrist et al. | |
| 5,685,693 | A | | 11/1997 | Sexton et al. | |
| 5,779,442 | A | | 7/1998 | Sexton et al. | |
| 5,890,873 | A | * | 4/1999 | Willey | 415/173.5 |
| 5,906,473 | A | | 5/1999 | Sexton et al. | |
| 5,913,658 | A | | 6/1999 | Sexton et al. | |
| 6,079,943 | A | | 6/2000 | Sexton et al. | |
| 6,082,963 | A | | 7/2000 | Sexton et al. | |
| 6,179,567 | B1 | * | 1/2001 | Stauffer et al. | 416/191 |
| 6,241,471 | B1 | | 6/2001 | Herron | |
| 6,382,632 | B1 | | 5/2002 | Chupp et al. | |
| 6,431,827 | B1 | | 8/2002 | Wolfe et al. | |
| 6,435,823 | B1 | | 8/2002 | Schroder | |
| 6,491,498 | B1 | * | 12/2002 | Seleski et al. | 416/191 |
| 6,520,836 | B1 | | 2/2003 | Dean et al. | |
| 6,679,681 | B1 | * | 1/2004 | Burnett et al. | 415/173.5 |

* cited by examiner

*Primary Examiner*—Hoang Nguyen
(74) *Attorney, Agent, or Firm*—Nixon & Vanderhye P.C.

(57) ABSTRACT

A bucket tip shroud in a gas turbine includes a seal rail having a cutter tooth at one end. Bucket tip shroud creep rate can be reduced by removing the cutter tooth from the bucket tip shroud seal rail after use or with a pre-groove honeycomb shroud. Preferably, the remaining geometry matches a geometry of the seal rail within a predetermined tolerance.

8 Claims, 1 Drawing Sheet

GAS TURBINE AND METHOD FOR REDUCING BUCKET TIP SHROUD CREEP RATE

BACKGROUND OF THE INVENTION

The present invention relates generally to gas turbines and, more particularly, to a gas turbine and method of reducing a bucket tip shroud creep rate by selectively removing cutter teeth on a seal rail of a bucket tip shroud.

In certain turbine designs, the bucket tip shrouds, constructed of a nickel-base superalloy, are prone to creep damage that may eventually lead to creep rupture and material loss. Creep rates in a gas turbine component are determined by the environmental conditions in which the component is placed. Tip shroud material loss can result in partial shroud-to-shroud contact with adjacent buckets. Such an occurrence may result in a forced outage, which obviously is disruptive and time-consuming to correct any damage.

Previous designs for bucket tip shrouds have included a scalloped configuration, which configuration helps to reduce the shroud lifting due to creep, but still fails to prevent creep damage at the high stress and high temperature fillet area. Redesigned buckets intending to solve the creep problems include features such as restacked airfoil, added cooling holes, different fillet sizes, more scalloped shrouds, etc.

BRIEF DESCRIPTION OF THE INVENTION

In an exemplary embodiment of the invention, a method of reducing a bucket tip shroud creep rate is provided. The bucket tip shroud includes a seal rail having a cutter tooth at one end. The method includes removing the cutter tooth from the bucket tip shroud seal rail. Preferably, the remaining geometry matches a geometry of the seal rail within a predetermined tolerance.

In another exemplary embodiment of the invention, a turbine includes a plurality of turbine buckets mounted for rotation with a turbine rotor. Each of the buckets includes a bucket tip shroud with a seal rail. A cutter tooth of a plurality of the bucket seal rails is removed to thereby reduce a bucket tip shroud creep rate.

DETAILED DESCRIPTION OF THE INVENTION

Figure 1:
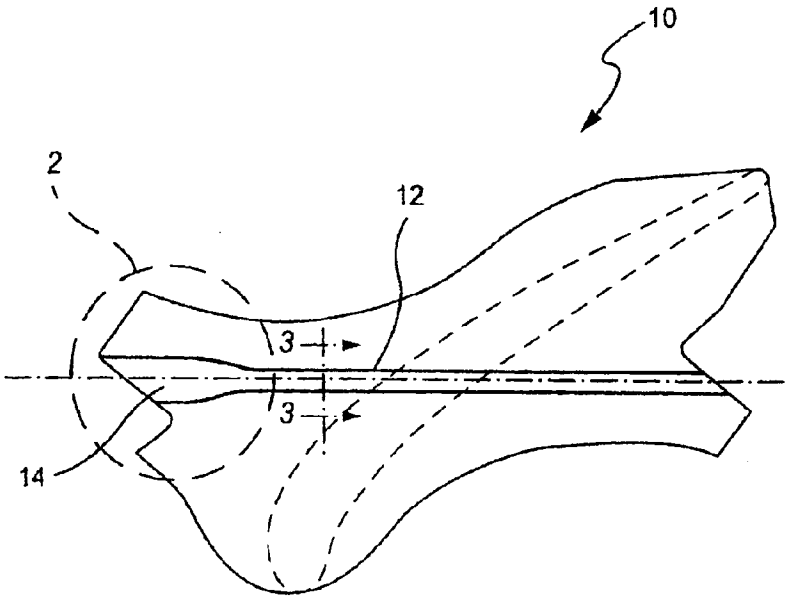
FIG. 1 illustrates a bucket tip shroud with seal rail including a cutter tooth at one end.
Figure 2:
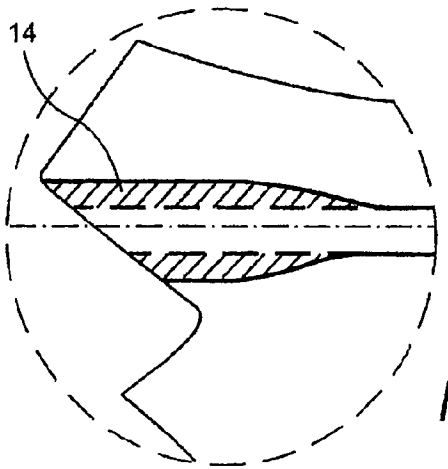
FIG. 2 is an enlarged view from detail B—B in FIG. 1.

FIG. 1 shows an exemplary bucket tip shroud 10 including a seal rail 12 with a cutter tooth 14 at one end. FIG. 2 is a close-up view of the cutter tooth 14.

The present invention utilizes pertinent design information to effect removal of the cutter tooth 14 from the tip shroud rail 12. It has been discovered that by removing the cutter tooth 14, creep rates can be reduced for the component. The cutter teeth removal (repair) extends the bucket shroud creep life and reduces the chance of creep rupture failure which leads to potential forced outage.

Figure 3:
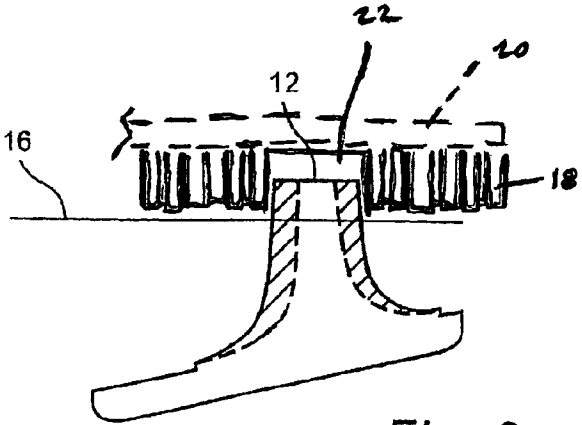
FIG. 3 is an axial cross section showing the seal rail geometry.

With reference to FIGS. 2 and 3, the cross-hatched area of the cutter tooth 14 is removed from the tip shroud seal rail

12 creating a new seal rail geometry for the bucket. The new resultant configuration maintains the seal rail 12 function and reduces the stress at the shroud by which improves the creep life of the component.

FIG. 3 details the new shape of the remaining rail 12 from the top of the rail to the upper surface of the shroud. Preferably, the material is removed in an amount such that the remaining geometry matches the rest of the rail 12 within specified tolerances. A radial height is defined by a line 16 between the bucket tip shroud 10 and a top of the seal rail 12. Above the line 16, a material is removed to define a linear taper of preferably about 5.3°, and below the line, material is removed into a generally circular radius that continues toward the upper surface of the shroud. In an exemplary embodiment, the circular radii are about 0.25 inches and 0.16 inches on each side.

The material can be removed using any known process such as EDM, machining or hand grinding to establish the desired axial cross section. Preferably, the part being repaired should be measured after the process to ensure that the proper dimensional change has been established.

In a conventional gas turbine, a honeycomb shroud 18 is installed in the casing 20 (shown in phantom in FIG. 3) adjacent the bucket tip shroud. In operation, the cutter teeth 14 on the seal rail 12 are particularly structured to cut a groove 22 in the honeycomb shroud 18 the position of which results from thermal expansion of the turbine rotor and buckets. Once the groove 22 is fully cut by the cutter teeth, the "repair" process of the present invention ma be implemented to improve creep resistance.

The honeycomb shroud 18 may alternatively be pre-grooved before assembly, in which case the cutter tooth "repair" can be effected at assembly. In still another alternative, if the gas turbine unit honeycomb shroud 18 has not been pre-grooved, the cutter teeth of only a portion of the plurality of bucket seal rails may be removed, such that the remaining cutter teeth, dispersed about the rotor, can cut the desired groove. Preferably, the cutter tooth "repair" process can be performed on about 70% of the buckets while leaving the remaining parts with their original configuration. This will prevent the potential risk caused by white noise input into the bucket row from a stationary shroud.

With the process of the present invention, a new seal rail geometry can be achieved for a turbine bucket that maintains the seal rail functionality while reducing the stress at the shroud to thereby improve bucket creep life.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of reducing a bucket tip shroud creep rate, the bucket tip shroud including a seal rail having a cutter tooth at one end disposed adjacent a casing shroud supported in a turbine casing, the method comprising removing the cutter tooth from the bucket tip shroud seal rail after a groove is formed in the casing shroud.

2. A method according to claim 1, wherein the removing step comprises removing the cutter tooth from the bucket tip shroud seal rail such that a remaining geometry matches a geometry of the seal rail within a predetermined tolerance.

3. A method according to claim 1, wherein a radial height is defined by a line between the bucket tip shroud and a top of the seal rail, and wherein the removing step comprises cutting a linear taper above the line, and cutting circular radii below the line on each side.

4. A method according to claim 3, wherein the liner taper is about 5.3 degrees.

5. A method according to claim 3, wherein the circular radii are about 0.25 inches and 0.16 inches on each side.

6. A method according to claim 1, wherein the removing step is practiced by one of EDM, machining or hand grinding.

7. A method according to claim 1, further comprising measuring the seal rail where the cutter tooth has been removed to ensure a proper dimensional change within predetermined tolerances.

8. A method according to claim 1, wherein the removing step is practiced after the bucket tip shroud has been in operation.

* * * * *

UNITED STATES PATENT AND TRADEMARK OFFICE

CERTIFICATE OF CORRECTION

PATENT NO. : 7,001,144 B2
APPLICATION NO. : 10/373845
DATED : February 21, 2006
INVENTOR(S) : Urban et al.

It is certified that error appears in the above-identified patent and that said Letters Patent is hereby corrected as shown below:

Column 2, line 26, “honeycomb shroud 18” should be --honeycomb shroud 18,--;

Column 2, line 29, delete “ma” and insert --may--.

Column 3, claim 4, line 3, delete “liner” and insert --linear--.

Signed and Sealed this

Twenty-second Day of August, 2006

JON W. DUDAS
*Director of the United States Patent and Trademark Office*